US011371125B2

(12) United States Patent
Yu et al.

(10) Patent No.: US 11,371,125 B2
(45) Date of Patent: Jun. 28, 2022

(54) WEAR-RESISTANT STEEL HAVING EXCELLENT HARDNESS AND IMPACT TOUGHNESS, AND METHOD FOR PRODUCING SAME

(71) Applicant: POSCO, Pohang-si (KR)

(72) Inventors: Seng-Ho Yu, Pohang-si (KR); Young-Jin Jung, Pohang-si (KR); Yong-Woo Kim, Pohang-si (KR)

(73) Assignee: POSCO, Pohang-si (KR)

( * ) Notice: Subject to any disclaimer, the term of this patent is extended or adjusted under 35 U.S.C. 154(b) by 0 days.

(21) Appl. No.: 16/954,673

(22) PCT Filed: Dec. 21, 2018

(86) PCT No.: PCT/KR2018/016539
§ 371 (c)(1),
(2) Date: Jun. 17, 2020

(87) PCT Pub. No.: WO2019/125083
PCT Pub. Date: Jun. 27, 2019

(65) Prior Publication Data

US 2021/0164079 A1 Jun. 3, 2021

(30) Foreign Application Priority Data

Dec. 22, 2017 (KR) ..... 10-2017-0178858

(51) Int. Cl.

| | |
|---|---|
| ***C22C 38/44*** | (2006.01) |
| ***C22C 38/00*** | (2006.01) |
| ***C22C 38/02*** | (2006.01) |
| ***C22C 38/04*** | (2006.01) |
| ***C22C 38/46*** | (2006.01) |
| ***C22C 38/52*** | (2006.01) |
| ***C21D 1/18*** | (2006.01) |
| ***C21D 8/02*** | (2006.01) |
| ***C21D 11/00*** | (2006.01) |
| ***C22C 38/06*** | (2006.01) |

(52) U.S. Cl.
CPC ..... *C22C 38/44* (2013.01); *C21D 1/18* (2013.01); *C21D 8/0226* (2013.01); *C21D 11/005* (2013.01); *C22C 38/002* (2013.01); *C22C 38/008* (2013.01); *C22C 38/02* (2013.01); *C22C 38/04* (2013.01); *C22C 38/06* (2013.01); *C22C 38/46* (2013.01); *C22C 38/52* (2013.01); *C21D 2211/001* (2013.01); *C21D 2211/002* (2013.01); *C21D 2211/008* (2013.01)

(58) Field of Classification Search
CPC ..... C22C 38/44; C22C 38/002; C22C 38/02; C22C 38/04; C22C 38/46; C22C 38/52; C21D 2211/008
USPC ..... 428/544
See application file for complete search history.

(56) References Cited

U.S. PATENT DOCUMENTS

| | | | | |
|---|---|---|---|---|
| 2006/0162823 | A1 | 7/2006 | Omori et al. | |
| 2015/0232971 | A1 | 8/2015 | Miura et al. | |
| 2016/0010191 | A1* | 1/2016 | Li | C22C 38/28 148/547 |
| 2016/0208352 | A1 | 7/2016 | Suikkanen et al. | |
| 2018/0237875 | A1 | 8/2018 | Im et al. | |
| 2019/0390293 | A1 | 12/2019 | Yu et al. | |

FOREIGN PATENT DOCUMENTS

| | | | |
|---|---|---|---|
| CN | 101440461 | A | 5/2009 |
| CN | 102517509 | A | 6/2012 |
| CN | 102943213 | A | 2/2013 |
| CN | 103194684 | A | 7/2013 |
| CN | 104911500 | A | 9/2015 |
| EP | 2881482 | A1 | 6/2015 |
| EP | 2980257 | A1 | 2/2016 |
| JP | S61-166954 | A | 7/1986 |
| JP | H08-041535 | A | 2/1996 |
| JP | 2002-020837 | A | 1/2002 |
| JP | 2002-080930 | A | 3/2002 |
| JP | 2005-256169 | A | 9/2005 |
| JP | 2007-092155 | A | 4/2007 |
| JP | 2016-079459 | A | 5/2016 |
| KR | 10-0702491 | B1 | 4/2007 |

(Continued)

OTHER PUBLICATIONS

MMTA, "Consequences for Cobalt", Sep. 20, 2017, The Crucible, Sep. 2017, URL: <https://mmta.co.uk/2017/09/20/consequences-for-cobalt/>, pp. 1-6 (Year: 2017).*

Davis et al., "Final Report on Effect of Impurities in Steel", Mar. 2006, Government of Canada, URL: <https://www.researchgate.net/publication/306293969_Final_Report_on_Effect_of_Impurities_in_Steel>, pp. 1-25 (Year: 2006).*

Chinese Office Action dated Jun. 10, 2021 issued in Chinese Patent Application No. 201880081198.7 (with English translation).

(Continued)

*Primary Examiner* — Humera N. Sheikh
*Assistant Examiner* — Katherine A Christy
(74) *Attorney, Agent, or Firm* — Morgan, Lewis & Bockius LLP

(57) ABSTRACT

A wear-resistant steel having excellent hardness and impact toughness and a method for producing same can include: 0.29-0.37 wt % of carbon, 0.1-0.7 wt % of silicon, 0.6-1.6 wt % of manganese, 0.05 wt % or less of phosphorus, 0.02 wt % or less of sulfur, 0.07 wt % or less of aluminum, 0.1-1.5 wt % of chromium, 0.01-0.8 wt % of molybdenum, 0.01-0.08 wt % of vanadium, 50 ppm or less of boron, and 0.02 wt % or less of cobalt; and optionally one or more of 0.5 wt % or less of nickel, 0.5 wt % or less of copper, 0.02 wt % or less of titanium, 0.05 wt % or less of niobium, and 2-100 ppm of calcium; with the remainder of Fe and other inevitable impurities.

4 Claims, No Drawings

(56) References Cited

FOREIGN PATENT DOCUMENTS

| | | | |
|---|---|---|---|
| KR | 10-2012-0071614 | A | 3/2012 |
| KR | 10-2012-0053616 | A | 5/2012 |
| KR | 10-2014-0137942 | A | 3/2014 |
| KR | 10-2016-0072099 | A | 6/2016 |
| KR | 10-1696094 | B1 | 1/2017 |
| KR | 10-2018-0073368 | A | 7/2018 |

OTHER PUBLICATIONS

International Search Report dated Apr. 1, 2019 issued in International Patent Application No. PCT/KR2018/016539 (along with English translation).

Extended European Search Report dated Aug. 10, 2020 issued in European Patent Application No. 18892429.4.

* cited by examiner

WEAR-RESISTANT STEEL HAVING EXCELLENT HARDNESS AND IMPACT TOUGHNESS, AND METHOD FOR PRODUCING SAME

CROSS-REFERENCE OF RELATED APPLICATIONS

This application is the U.S. National Phase under 35 U.S.C. § 371 of International Patent Application No. PCT/KR2018/016539, filed on Dec. 21, 2018, which in turn claims the benefit of Korean Application No. 10-2017-0178858, filed on Dec. 22, 2017, the entire disclosures of which applications are incorporated by reference herein.

TECHNICAL FIELD

The present disclosure relates to high-hardness wear-resistant steel and a method for producing the same, and more particularly, to high-hardness wear-resistant steel, able to be used in construction machinery, or the like, and a method for producing the same.

BACKGROUND ART

Construction machines and industrial machines used in various fields of industry such as construction, civil engineering, the mining industry, the cement industry, and the like, require the application of a material exhibiting wear-resistant characteristics as wear caused by friction may be severe during working.

Since wear resistance and hardness of a thick plate are generally related to each other, it is necessary to increase the hardness of the thick plate concerned with wear. To secure more stable wear resistance, it is necessary to have uniform hardness (for example, to have the same degree of hardness on a surface and in an interior of a thick plate) from a surface of the thick plate through the interior of a plate thickness (t/2 vicinity, t=thickness).

In general, a method of reheating to an Ac3 temperature or higher after rolling and then performing hardening is widely used to obtain high hardness in a thick plate. As an example, Patent Document 1 discloses a method of increasing surface hardness by increasing a content of carbon (C) and adding a large amount of hardenability improving elements such as chromium (Cr), molybdenum (Mo), and the like. However, to manufacture an ultra-thick steel plate, more hardenable elements needs to be added to secure hardenability of a central region of a steel plate. In this case, as large amounts of C and hardenable alloy are added, manufacturing costs may be increased and weldability and low-temperature toughness may be deteriorated.

Accordingly, there is demand for a method capable of securing high strength and high impact toughness as well as securing excellent wear resistance by securing high hardness in a situation in which a hardenable alloy is inevitably added to secure hardenability.

PRIOR ART DOCUMENT (Patent Document 1) Japanese Patent Laid-Open Publication No. 1986-166954

DISCLOSURE

Technical Problem

An aspect of the present disclosure is to provide high-hardness wear-resistant steel having high strength and high impact toughness as well as having excellent wear resistance and a method for producing the same.

Technical Solution

According to another aspect of the present disclosure, a method for producing wear-resistant steel having excellent hardness and impact toughness includes: heating a steel slab to a temperature within a range of 1050 to 1250° C., the steel slab comprising, by weight percentage (wt %): 0.29 to 0.37% of carbon (C), 0.1 to 0.7% of silicon (Si), 0.6 to 1.6% of manganese (Mn), 0.05% or less (excluding 0%) of phosphorus (P), 0.02% or less (excluding 0%) of sulfur (S), 0.07% or less (excluding 0%) of aluminum (Al), 0.1 to 1.5% of chromium (Cr), 0.01 to 0.8% of molybdenum (Mo), 0.01 to 0.08% of vanadium (V), 50 ppm or less (excluding 0%) of boron (B), and 0.02% or less (excluding 0%) of cobalt (Co), further comprising: at least one selected from the group consisting of 0.5% or less (excluding 0%) of nickel (Ni), 0.5% or less (excluding 0%) of copper (Cu), 0.02% or less (excluding 0%) of titanium (Ti), 0.05% or less (excluding 0%) of niobium (Nb), and 2 to 100 ppm of calcium (Ca), and comprising: the remainder of iron (Fe) and other inevitable impurities, wherein the Cr, Mo, and V satisfy Relational Expression 1; rough rolling the heated steel slab to a temperature within a range of 950 to 1050° C. to obtain a rough-rolled bar; finishing hot rolling the rough-rolled bar to a temperature within a range of 850 to 950° C. to obtain a hot-rolled steel sheet; air cooling the hot-rolled steel sheet and reheating the air-cooled hot-rolled steel sheet to a temperature within a range of 880 to 930° C. during an in-furnace time of 1.3t+10 minutes to 1.3t+60 minutes (t: plate thickness); water cooling the reheated hot-rolled steel sheet to a temperature of 150° C. or less; and increasing a temperature of the water-cooled hot-rolled steel sheet to a temperature within a range of 350° C. to 600° C. and heat-treating the hot-rolled steel sheet for 1.3t+5 minutes to 1.3t+20 minutes (t: plate thickness), Relational Expression 1: $Cr \times Mo \times V \geq 0.005$ (where the contents of Cr, Mo and V are in wt %).

According to another aspect of the present disclosure, a method for producing wear-resistant steel having excellent hardness and impact toughness includes: heating a steel slab to a temperature within a range of 1050 to 1250° C., the steel slab comprising, by weight percentage (wt %): 0.29 to 0.37% of carbon (C), 0.1 to 0.7% of silicon (Si), 0.6 to 1.6% of manganese (Mn), 0.05% or less (excluding 0%) of phosphorus (P), 0.02% or less (excluding 0%) of sulfur (S), 0.07% or less (excluding 0%) of aluminum (Al), 0.1 to 1.5% of chromium (Cr), 0.01 to 0.8% of molybdenum (Mo), 0.01 to 0.08% of vanadium (V), 50 ppm or less (excluding 0%) of boron (B), and 0.02% or less (excluding 0%) of cobalt (Co), further comprising: at least one selected from the group consisting of 0.5% or less (excluding 0%) of nickel (Ni), 0.5% or less (excluding 0%) of copper (Cu), 0.02% or less (excluding 0%) of titanium (Ti), 0.05% or less (excluding 0%) of niobium (Nb), and 2 to 100 ppm of calcium (Ca), and comprising: the remainder of iron (Fe) and other inevitable impurities, wherein the Cr, Mo, and V satisfy Relational Expression 1; rough rolling the reheated steel slab to a temperature within a range of 950 to 1050° C. to obtain a rough-rolled bar; finishing hot rolling the rough-rolled bar to a temperature within a range of 850 to 950° C. to obtain a hot-rolled steel sheet; air cooling the hot-rolled steel sheet and reheating the air-cooled hot-rolled steel sheet to a temperature within a range of 880 to 930° C. during an in-furnace time of 1.3t+10 minutes to 1.3t+60 minutes (t:

plate thickness); water cooling the reheated hot-rolled steel sheet to a temperature of 150° C. or less; and increasing a temperature of the water-cooled hot-rolled steel sheet to a temperature within a range of 350° C. to 600° C. and heat-treating the hot-rolled steel sheet for 1.3t+5 minutes to 1.3t+20 minutes (t: plate thickness), Relational Expression 1: $Cr \times Mo \times V \geq 0.005$ (where the contents of Cr, Mo, and V are in wt %).

Advantageous Effects

According to an aspect of the present disclosure, wear-resistant steel, having high hardness and excellent low-temperature toughness while having a thickness of 60 mm or less, may be provided.

BEST MODE FOR INVENTION

Hereinafter, the reason that the alloy composition of wear-resistant steel having excellent hardness and impact toughness provided according to an embodiment in the present disclosure is controlled as described above will be described in detail. In this case, unless otherwise specified, the content of each component refers to weight percentage (wt %).

Carbon (C): 0.29 to 0.37%

Carbon (C) is an element effective in increasing strength and hardness in steel having a martensite structure and is an effective element for improving hardenability. To sufficiently secure the above-mentioned effect, C may be added in an amount of, in detail, 0.29% or more. However, when the content of C is greater than 0.37%, weldability and toughness may be deteriorated. Therefore, in the present disclosure, the content of C may be controlled to be 0.29 to 0.37%. A lower limit of the content of C may be, in more detail, 0.295%, in even more detail, 0.3%, and, in most detail, 0.305%. An upper limit of the content of C may be, in more detail, 0.365%, in even more detail, 0.36%, and, in most detail, 0.355%.

Silicon (Si): 0.1 to 0.7%

Silicon (Si) is an element effective in improving strength by deoxidation and solid solution strengthening. To obtain the above-mentioned effect, C may be added in an amount of, in detail, 0.1% or more. However, when the content of Si is greater than 0.7%, weldability may be deteriorated, and thus, the content is not preferable. Therefore, in the present disclosure, the content of Si may be controlled to be 0.1 to 0.7%. A lower limit of the content of Si may be, in more detail, 0.12%, in even more detail, 0.15%, and in most detail, 0.18%. An upper limit of the content of Si may be, in more detail, 0.65%, in even more detail, 0.60%, and, in most detail, 0.50%.

Manganese (Mn): 0.6 to 1.6%

Manganese (Mn) is an element suppressing formation of ferrite and lowering a temperature $Ar_3$ such that hardenability is effectively increased to improve strength and toughness of steel. In the present disclosure, to secure hardness of a thick steel plate, Mn is contained in an amount of, in detail, 0.6% or more. However, when the content of Mn is greater than 1.6%, weldability may be deteriorated. Therefore, in the present disclosure, the content of Mn may be controlled to be 0.6 to 1.6%. A lower limit of the content of Mn may be, in even more detail, 0.62%, in further detail, 0.65%, and in most detail 0.70%. An upper limit of the content of Mn may be, in more detail, 1.63%, in even more detail, 1.60%, and, inmost detail, 1.55%.

Phosphorus (P): 0.05% or less (excluding 0%)

Phosphorus (P) is an element inevitably contained in steel to deteriorate toughness of steel. Therefore, the content of P should be maintained as low as possible. The content of P may be preferably controlled to be 0.05% or less. However, 0% is excluded considering the level of inevitably contained P.

Sulfur (S): 0.02% or less (excluding 0%)

Sulfur (S) is an element deteriorating toughness of steel by forming MnS inclusions in the steel. Therefore, the content of S may be reduced as low as possible and may be controlled to be 0.02% or less. However, 0% is excluded considering the level of inevitably contained S.

Aluminum (Al): 0.07% or less (excluding 0%)

Aluminum (Al) is a deoxidizing agent for steel and is an element effective in decreasing the content of oxygen in molten steel. When the content of Al is greater than 0.07%, cleanliness of the steel may be deteriorated, which is not preferable. Therefore, in the present disclosure, the content of Al may be controlled to be 0.07% or less. However, 0% is excluded considering an increase of load and manufacturing costs in a steelmaking process.

Chromium (Cr): 0.1 to 1.5%

Chromium (Cr) increases hardenability to improve strength of steel and is an element advantageous for securing hardness. To obtain the above-mentioned effect, Cr may be added in an amount of 0.1% or more. However, when the content of Cr is greater than 1.5%, weldability may be deteriorated and manufacturing costs may be increased. A lower limit of the content of Cr may be, in more detail, 0.12%, in even more detail, 0.15%, and, inmost detail, 0.2%. An upper limit of the content of Cr may be, in more detail, 1.4%, in even more detail, 1.3%, and in most detail, 1.2%.

Molybdenum (Mo): 0.01 to 0.8%

Molybdenum (Mo) increases hardenability of steel and is an element effective in improving hardness of a thick steel plate. To sufficiently obtain the above-mentioned effect, Mo may be added in an amount of 0.01% or more. However, Mo is also an expensive element and, when the content of Mo is greater 0.8%, manufacturing costs may be increased and weldability may be deteriorated. Therefore, in the present disclosure, the content of Mo may be controlled to be 0.01 to 0.8%. A lower limit of the content of Mo may be, in more detail, 0.03% and, in even more detail, 0.05%. An upper limit of the content of Mo may be, in more detail, 0.75% and, in even more detail, 0.7%.

Vanadium (V): 0.01 to 0.08%

Vanadium (V) an element advantageous for suppressing growth of austenite grains, by forming vanadium carbide (VC) during reheating after hot rolling, and improving hardenability of steel to secure strength and toughness. To sufficiently secure the above-mentioned effect, V may be added in an amount of, in detail, 0.01% or more. However, when the content of V is greater than 0.08%, manufacturing costs may be increased. Therefore, in the present disclosure, the content of V may be controlled to be 0.01 to 0.08%. A lower limit of the content of V may be, in more detail, 0.03% and, in even more detail, 0.05%. An upper limit of the content of V may be, in more detail, 0.07% and, in even more detail, 0.06%.

Boron (B): 50 ppm or less (excluding 0%)

Boron (B) is an element effective in improving strength by effectively increasing hardenability of steel even when a small amount of B is added. However, when the content of B is excessive, toughness and weldability of steel may be deteriorated. Therefore, the content of B may be controlled to be, in detail, 50 ppm or less. The content of B may be, in more detail, 40 ppm or less, in even more detail, 35 ppm or less and, in most detail, 30 ppm or less.

Cobalt (Co): 0.02% or less (excluding 0%)

Cobalt (Co) is an element advantageous for securing hardness as well as strength of steel by increasing hardenability of the steel. However, when the content of Co is greater than 0.02%, the hardenability of the steel may be deteriorated. In addition, manufacturing costs may be increased because Co is an expensive element. Therefore, in the present disclosure, Co may be added in an amount of, in detail, 0.02% or less. The content of Co may be, in more detail, 0.018% or less and, in even more detail, 0.015% or less and, in most detail, 0.013% or less.

The wear-resistant steel of the present disclosure may further include elements, advantageous for securing target physical properties of the present disclosure, in addition to the above-mentioned alloy composition. The wear-resistant steel of the present disclosure may further include at least one selected from the group consisting of, for example, nickel (Ni): 0.5% or less (excluding 0%), copper (Cu): 0.5% or less (excluding 0%), titanium (Ti): 0.02% or less (excluding 0%), niobium (Nb): 0.05% or less (excluding 0%), vanadium (V): 0.05% or less (excluding 0%), and calcium (Ca): 2 to 100 ppm.

Nickel (Ni): 0.5% or less (excluding 0%)

Nickel (Ni) is generally an element effective in improving toughness and strength of steel. However, when the content of Ni is greater than 0.5%, manufacturing costs may be increased. Therefore, Ni may be added in an amount of 0.5% or less. The content of Ni may be, in more detail, 0.48% or less, in even more detail, 0.45% or less and, in most detail, 0.4% or less.

Copper (Cu): 0.5% or less (excluding 0%)

Copper (Cu) is an element improving hardenability of steel and improving strength and hardness of the steel by solid solution strengthening. However, when the content of Cu is greater than 0.5%, a surface defect may occur and hot workability may be deteriorated. Therefore, Cu may be added in an amount of 0.5% or less. An upper limit of the content of Cu may be, in more detail, 0.45%, in even more detail, 0.43% and, in most detail, 0.4%.

Titanium (Ti): 0.02% or less (excluding 0%)

Titanium (Ti) is an element effective in significantly increasing the effect of B effective in improving hardenability of steel. Specifically, Ti may bind to nitrogen (N) to form a TiN precipitate, such that formation of BN may be suppressed to increase solid-solubilized B to significantly improve hardenability. However, when the content of Ti is greater than 0.02%, a coarse TiN precipitate may be formed to deteriorate toughness of the steel. Therefore, in the present disclosure, Ti is added in an amount of, in detail, 0.02% or less. The content of Ti may be, in more detail, 0.019% or less, in even more detail, 0.018% or less and, inmost detail, 0.017% or less.

Niobium (Nb): 0.05% or less (excluding 0%)

Niobium (Nb) is solid-solubilized in austenite to increase hardenability of austenite and is effective in increasing strength of steel and suppressing austenite grain growth by forming carbonitride such as Nb(C,N). However, when the content of Nb is greater than 0.05%, a coarse precipitate may be formed to start brittle fracture, and thus, toughness may be deteriorated. Therefore, in the present disclosure, Nb may be added in an amount of, detail, 0.05% or less. The content of Nb may be, in more detail, 0.045% or less, in even more detail, 0.04% or less and, in most detail, 0.03% or less.

Calcium (Ca): 2 to 100 ppm

Calcium (Ca) has an effect of suppressing formation of MnS segregated at the center region of a steel material in a thickness direction, by generating CaS due to strong binding force of Ca with S. In addition, the CaS generated by the addition of Ca has an effect of increasing corrosion resistance under a high humidity environment. To obtain the above-mentioned effect, Ca may be added in an amount of, in detail, 2 ppm or more. However, when the content of Ca is greater than 100 ppm, it is not preferable clogging of a nozzle, or the like, may occur during a steelmaking operation. Therefore, in the present disclosure, the content of added Ca may be controlled to be, in detail, 2 to 100 ppm. A lower limit of the content of Ca may be, in more detail, 2.5 ppm, in even more detail, 3 ppm and, inmost detail, 3.5 ppm. An upper limit of the content of Ca may be, in more detail, 80 ppm, in even more detail, 60 ppm and, in most detail, 40 ppm.

In addition, the wear-resistant steel of the present disclosure may further include at least one selected from the group consisting of arsenic (As): 0.05% or less (excluding 0%), tin (Sn): 0.05% or less (excluding 0%), and tungsten (W): 0.05% or less (excluding 0%).

The As is effective in improving toughness of steel, and the Sn is effective in improving strength and corrosion resistance of the steel. In addition, the W is an element effective in improving hardness and improving hardness at high temperature by increasing hardenability. However, when the content of each of the As, Sn, and W is greater than 0.05%, manufacturing costs may be increased and physical properties of steel may be deteriorated. Therefore, in the present disclosure, when the wear-resistant steel additionally includes As, Sn, or W, the contents thereof may be controlled to each be 0.05% or less.

In the embodiments of the present disclosure, the other component of the steel is iron (Fe). However, impurities in raw materials or manufacturing environments may be inevitably included in the steel, and such impurities may not be able to be removed from the steel, such impurities are well-known to those of ordinary skill in the art to which the present disclosure pertains, and thus descriptions thereof will not be given in the present disclosure.

Among the above-mentioned alloy components of the wear-resistant steel according to the present disclosure, Cr, Mo, and V may satisfy, in detail, Relational Expression 1. When Cr, Mo, and V do not satisfy Relational Expression 1, it may be difficult to secure both hardness and low-temperature impact toughness desired to be obtained in the present disclosure.

Relational Expression 1: $Cr \times Mo \times V \geq 0.005$ (where the contents of Cr, Mo, and V are in wt %)

A microstructure of the wear-resistant steel according to the present disclosure may include, in detail, martensite as a matrix structure. More specifically, the wear-resistant steel may include, in detail, martensite having an area fraction of 90% or more (including 100%). When a fraction of martensite is less than 90%, it may be difficult to secure a target level of strength and hardness. The microstructure of the wear-resistant steel may further include at least one of 10% or less of retained austenite and bainite, and thus, the low-temperature impact toughness may be further improved. In the present disclosure, a martensite phase includes a tempered martensite phase. In such a case in which the martensite includes the tempered martensite phase, toughness of steel may be more advantageously secured. A fraction of the martensite may be, in more detail, 95 area % or more.

In the present disclosure, the martensite may have an average packet size of, in detail, 30 μm or less. As described above, the average packet size of the martensite may be controlled to be 30 μm or less to improve both hardness and toughness. The average packet size of the martensite may be, in more detail, 20 μm or less, in even more detail, 15 μm or less and, inmost detail, 10 μm or less. The smaller the average packet size of the martensite, the more advantageous it may be to secure physical properties. In the present disclosure, an upper limit of the average packet size of the martensite is not necessarily limited. The term "martensite packet" refers to lath and block martensite groups having the same crystal orientation.

Kernel average misorientation (KAM) of martensite of the present disclosure may be, in detail, 0.45 to 0.8. The KAM is an index of dislocation density. The KAM has a value of 0 to 1. When the KAM approaches 1, it is interpreted as being an increase in the dislocation density. In the present disclosure, when the KAM is less than 0.45, low dislocation density may make it difficult to secure sufficient hardness. When the KAM is greater than 0.8, it may be difficult to secure low-temperature toughness.

The above-described wear-resistant steel according to the present disclosure is effective in not only securing surface hardness of 460 to 540 HB but also having impact absorption energy of 47 J or more at a low temperature of −40° C.

In addition, the wear-resistant steel according to the present disclosure may have hardness HB and impact absorption energy J satisfying, in detail, Relational Expression 2. A feature of the present disclosure is to improve low-temperature toughness characteristics, in addition to high hardness. To this end, it may be preferable to satisfy Relational Expression 2. For example, when Relational Expression 2 is not satisfied because only surface hardness is high and impact toughness is poor or when Relational Expression 2 is not satisfied when impact toughness is excellent but surface hardness does not reach a target value, finally targeted high hardness and low-temperature toughness characteristics may not be guaranteed.

Relational Expression 2: $HB \times J \geq 25000$ (where HB denotes surface hardness of steel measured by a Brinell hardness tester and J denotes an impact absorption energy value at a temperature of −40° C.)

Hereinafter, a method for producing wear-resistant steel according to the present disclosure will be described in detail.

A steel slab is heated to a temperature within a range of 1050 to 1250° C. When the heating temperature of the steel slab is lower than 1050° C., solid re-solution of Nb, or the like, may be insufficient. Meanwhile, when the heating temperature of the steel slab is higher than 1250° C., austenite grains may be coarsened and an uneven structure may be formed. Therefore, in the present disclosure, the heating temperature of the steel slab may be in the range of, in detail, 1050 to 1250° C.

The heated steel slab is rough-rolled to a temperature within a range of 950 to 1050° C. to obtain a rough-rolled bar. When the temperature is lower than 950° C. during the rough rolling, a rolling load is increased to perform relatively weak processing, so that deformation is not sufficiently applied to the center of the slab in a thickness direction, and thus, defects such as pores may not be removed. On the other hand, when the temperature is higher than 1050° C., grains may grow after recrystallization occurs simultaneously with rolling, and thus, initial austenite grains may be significantly coarsened.

The rough-rolled bar is finishing hot-rolled to a temperature within a range of 850 to 950° C. to manufacture a hot-rolled steel sheet. When the finishing hot-rolling temperature is lower than 850° C., there is a possibility that ferrite may be formed in the microstructure due to two-phase region rolling. On the other hand, when the temperature is higher than 950° C., a final grain size may be coarsened to deteriorate low-temperature toughness.

The hot-rolled steel sheet is air-cooled to room temperature, and then reheated to a temperature within a range of 880 to 930° C. for an in-furnace time of 1.3t+10 minutes (t: plate thickness) or more. The reheating is performed to reversely transform the hot-rolled steel sheet, including ferrite and pearlite, into an austenite single phase. When the reheating temperature is lower than 880° C., austenitization is insufficiently performed and coarse soft ferrite is mixed, and thus, hardness of an end product may be lowered. On the other hand, when the temperature is higher than 930° C., austenite grains may be coarsened to increase hardenability, but low-temperature toughness of steel may be deteriorated.

The reheated hot-rolled steel sheet is water-cooled to a temperature of 150° C. or less, based on the center of the plate thickness (for example, ½t point (t: plate thickness (mm)). The water-cooling rate may be, in detail, 2° C./sec or more. When the cooling rate is less than 2° C./sec or a cooling end temperature is higher than 150° C., a ferrite phase may be formed or a bainite phase may be excessively formed during the cooling. In the present disclosure, an upper limit of the cooling rate is not necessarily limited and may be appropriately set, considering an equipment limitation, by those skilled in the art. On the other hand, the cooling rate during water cooling may be, in more detail, 5° C./sec or more, and, in even more detail 7° C./sec or more.

The cooled hot-rolled steel sheet is heated to a temperature within a range of 350 to 600° C., and then heat-treated within 1.3t+20 minutes (t: plate thickness). When the tempering temperature is lower than 350° C., brittleness of tempered martensite may occur, and thus, the strength and the toughness of the steel may be deteriorated. On the other hand, when the tempering temperature is higher than 600° C., dislocation density in martensite, increased through reheating and cooling, may be rapidly decreased. Thus, hardness may be decreased, as compared with a target value. As a result, the tempering temperature higher than 600° C. is not preferable. In addition, when the tempering time is greater than 1.3t+20 minutes (t: plate thickness), the high dislocation density in the martensite structure, generated after the rapid cooling, may be decreased to result in a rapid decreased in hardness. Meanwhile, the tempering time should be 1.3t+5 minutes (t: plate thickness) or more. When the tempering time is less than 1.3t+5 minutes (t: plate thickness), a heat treatment may not be uniformly performed in a width direction and a length direction of the steel sheet to cause a location-dependent deviation of physical properties. An air-cooling treatment may be performed, in detail, after the heat treatment.

The hot-rolled steel sheet of the present disclosure may be a thick plate having a thickness of 60 mm or less, subjected to the above-mentioned process conditions, and may have a thickness of, in more detail, 5 to 50 mm and, in even more detail, 5 to 40 mm.

Most for Invention

Hereinafter, the present disclosure will be described more specifically according to an example. However, the following example should be considered in a descriptive sense only and not for purposes of limitation. The scope of the present disclosure is defined by the appended claims, and modifications and variations able to be reasonably made therefrom.

EXAMPLE

After preparing a steel slab having an alloy composition of Table 1, steel slab heating—rough rolling—hot rolling—cooling (room temperature)—reheating—water cooling—tempering were performed on the steel slab under the conditions of Table 2 to manufacture a hot-rolled steel sheet. A microstructure, KAM, and mechanical properties of the hot-rolled steel sheet were measured and then listed in Table 3.

In this case, after a specimen was cut to an arbitrary size to form a mirror surface and then etched using a nital etchant, a ½t location, a center of thickness, was observed using an optical microscope and an electron scanning microscope.

The KAM was analyzed for an area of 200 μm×200 μm through EBSD.

In addition, hardness and toughness were measured using a Brinell hardness tester (a load of 3000 kgf and a tungsten pressing inlet of 10 mm) and a Charpy impact tester, respectively. In this case, surface hardness was an average of values obtained by measuring surface hardness three times after 2 mm milling of a plate surface. In addition, a result of the Charpy impact test was an average of values obtained by measuring toughness three times at a temperature of −40° C. after taking a specimen in a ¼t location.

TABLE 1

| | Alloy Composition (Wt %) | | | | | | | | | |
|---|---|---|---|---|---|---|---|---|---|---|
| Classification | C | Si | Mn | P | S | Al | Cr | Mo | V | B |
| CS1 | 0.327 | 0.35 | 1.67 | 0.012 | 0.0033 | 0.031 | 0.65 | 0.01 | 0.03 | 0.0017 |
| CS2 | 0.254 | 0.38 | 0.85 | 0.009 | 0.0012 | 0.035 | 0.12 | 0.13 | 0.01 | 0.0002 |
| CS3 | 0.42 | 0.31 | 1.51 | 0.017 | 0.0013 | 0.026 | 0.45 | 0.19 | 0.02 | 0.0018 |
| IS1 | 0.305 | 0.25 | 0.85 | 0.007 | 0.002 | 0.046 | 0.78 | 0.56 | 0.06 | 0.0014 |
| IS2 | 0.336 | 0.3 | 1.38 | 0.008 | 0.0008 | 0.024 | 0.58 | 0.65 | 0.05 | 0.0022 |
| IS3 | 0.361 | 0.31 | 1.37 | 0.007 | 0.002 | 0.025 | 0.31 | 0.48 | 0.04 | 0.002 |

| | Alloy Composition (Wt %) | | | | | | | | | |
|---|---|---|---|---|---|---|---|---|---|---|
| Classification | Co | Ni | Cu | Ti | Nb | Ca | As | Sn | W | RE 1 |
| CS1 | — | 0.14 | 0.05 | 0.014 | 0.041 | 0.0002 | — | — | — | 0.0002 |
| CS2 | — | 0.51 | 0.15 | 0.017 | 0.017 | 0.0004 | — | — | — | 0.0002 |
| CS3 | 0.01 | 0.09 | 0.02 | 0.016 | 0.016 | 0.0009 | 0.003 | 0.003 | — | 0.0017 |
| IS1 | 0.01 | 0.17 | 0.11 | 0.003 | 0.013 | 0.0005 | — | — | — | 0.0262 |
| IS2 | 0.01 | 0.08 | 0.05 | 0.015 | 0.015 | 0.0012 | 0.002 | 0.004 | — | 0.0189 |
| IS3 | 0.01 | 0.34 | 0.12 | 0.014 | 0.014 | 0.0003 | 0.003 | 0.003 | 0.01 | 0.0060 |

RE1 (Relational Expression 1): Cr × Mo × V ≥ 0.005 (where the contents of Cr, Mo, and V are in wt %)
CS: Comparative Steel/IS: Inventive Steel

TABLE 2

| Classification | Steel Type No. | Slab Heating Temperature (° C.) | Rough Rolling Temperature (° C.) | Finishing Hot Rolling Temperature | Reheating Temperature (° C.) | Reheating In-Furnace Time (min) |
|---|---|---|---|---|---|---|
| CE1 | CS1 | 1068 | 965 | 820 | 912 | 25 |
| CE2 | | 1131 | 1084 | 961 | 860 | 38 |
| CE3 | | 1142 | 985 | 934 | 935 | 62 |
| CE4 | CS2 | 1132 | 1050 | 945 | 906 | 35 |
| CE5 | | 1165 | 979 | 943 | 868 | 48 |
| CE6 | | 1127 | 975 | 948 | 899 | 49 |
| CE7 | CS3 | 1155 | 1002 | 915 | 900 | 37 |
| CE8 | | 1124 | 986 | 913 | 902 | 59 |
| CE9 | | 1130 | 977 | 936 | 901 | 65 |
| IE1 | IS1 | 1125 | 1041 | 894 | 910 | 31 |
| IE2 | | 1123 | 1017 | 925 | 908 | 48 |
| IE3 | | 1164 | 980 | 94 | 889 | 72 |
| CE10 | IS2 | 1150 | 1034 | 912 | 928 | 48 |
| IE4 | | 1142 | 1010 | 935 | 901 | 51 |
| IE5 | | 1138 | 987 | 94 | 913 | 66 |
| IE6 | IS3 | 1119 | 1027 | 868 | 924 | 27 |
| IE7 | | 1134 | 997 | 936 | 916 | 48 |
| CE11 | | 1125 | 968 | 938 | 940 | 75 |

| Classification | Cooling Rate (° C./s) | Cooling End Temperature (° C.) | Tempering Temperature (° C.) | Tempering Time (min) | Thickness (mm) |
|---|---|---|---|---|---|
| CE1 | 32.5 | 130 | — | — | 10 |
| CE2 | 24.6 | 75 | — | — | 20 |

TABLE 2-continued

| | | | | | |
|---|---|---|---|---|---|
| CE3 | 11.3 | 43 | 458 | 63 | 40 |
| CE4 | 32.5 | 35 | — | — | 19 |
| CE5 | 23.1 | 26 | 430 | 40 | 25 |
| CE6 | 11.1 | 129 | 432 | 43 | 28 |
| CE7 | 26.9 | 36 | 385 | 33 | 20 |
| CE8 | 14.7 | 138 | — | — | 35 |
| CE9 | 7.4 | 24 | 623 | 64 | 40 |
| IE1 | 54 | 27 | 400 | 34 | 15 |
| IE2 | 34.4 | 32 | 395 | 49 | 25 |
| IE3 | 13.1 | 25 | 384 | 62 | 40 |
| CE10 | 41.4 | 29 | — | — | 20 |
| IE4 | 25.8 | 27 | 430 | 47 | 20 |
| IE5 | 15.1 | 22 | 412 | 63 | 40 |
| IE6 | 47.8 | 31 | 530 | 21 | 10 |
| IE7 | 23.4 | 30 | 412 | 42 | 25 |
| CE11 | 12.5 | 19 | — | — | 40 |

CE: Comparative Example/IE: Inventive Example
CS: Comparative Steel/IS: Inventive Steel

TABLE 3

| | Microstructure (area %) | | | | | |
|---|---|---|---|---|---|---|
| Classification | Martensite | At least one of Retained Austenite and Bainite | KAM | Surface Hardness (HB) | Impact Toughness (J, @ −40° C.) | Relational Expression 2 |
| CE1 | 99 | 1 | 0.86 | 574 | 17 | 9758 |
| CE2 | 98 | 2 | 0.88 | 570 | 11 | 6270 |
| CE3 | 99 | 1 | 0.42 | 445 | 55 | 24475 |
| CE4 | 100 | 0 | 0.82 | 514 | 42 | 21588 |
| CE5 | 99 | 1 | 0.43 | 450 | 60 | 27000 |
| CE6 | 99 | 1 | 0.41 | 432 | 67 | 28944 |
| CE7 | 100 | 0 | 0.82 | 523 | 13 | 6799 |
| CE8 | 95 | 5 | 0.91 | 646 | 6 | 3876 |
| CE9 | 98 | 2 | 0.40 | 440 | 49 | 21560 |
| IE1 | 100 | 0 | 0.59 | 506 | 57 | 28842 |
| IE2 | 99 | 1 | 0.68 | 495 | 61 | 30195 |
| IE3 | 98 | 2 | 0.61 | 521 | 51 | 26571 |
| CE10 | 100 | 0 | 0.84 | 581 | 19 | 11039 |
| IE4 | 100 | 0 | 0.76 | 521 | 49 | 25529 |
| IE5 | 99 | 1 | 0.74 | 510 | 60 | 30600 |
| IE6 | 100 | 0 | 0.48 | 477 | 81 | 38637 |
| IE7 | 100 | 0 | 0.75 | 522 | 67 | 34974 |
| CE11 | 98 | 2 | 0.87 | 601 | 18 | 10818 |

[Relational Expression 2] HB × J (where HB denotes surface hardness of steel measured by a Brinell hardness tester and J denotes an impact absorption energy value at a temperature of −40° C.)
CE: Comparative Example/IE: Inventive Example As can be seen from Tables 1 to 3, Inventive Examples 1 to 7, satisfying the alloy composition, Relational Expression 1, and manufacturing conditions proposed by the present disclosure, satisfy the microstructure and the KAM of the present disclosure and secured excellent hardness and low-temperature impact toughness.

Meanwhile, Comparative Examples 1, 2, 3, 4, 5, 8 and 9, not satisfying the alloy composition or Relational Expression 1 as well as the manufacturing condition proposed by the present disclosure, do not reach a target level of hardness and low-temperature toughness of the present disclosure.

As also can be seen from Tables 1 to 3, Comparative Examples 6 and 7, satisfying the manufacturing conditions proposed by the present disclosure but not satisfying the alloy composition and Relational Expression 1, do not secure excellent hardness and low-temperature impact toughness.

As also can be seen from Tables 1 to 3, Comparative Examples 10 and 11, satisfying the alloy composition and Relational Expression 1 proposed by the present disclosure but not being tempered or not satisfying a reheating temperature, do not reach the target level of hardness and low-temperature toughness of the present disclosure.

As also can be seen from Tables 1 to 3, all of Comparative Examples 1 to 11, being out of the range of KAM proposed by the present disclosure, do not reach the target level of hardness and low-temperature impact toughness.

The invention claimed is:

1. Wear-resistant steel having excellent hardness and impact toughness comprising, by weight percentage (wt %): 0.29 to 0.37% of carbon (C), 0.1 to 0.7% of silicon (Si), 0.6 to 1.6% of manganese (Mn), 0.05% or less (excluding 0%) of phosphorus (P), 0.02% or less (excluding 0%) of sulfur (S), 0.07% or less (excluding 0%) of aluminum (Al), 0.1 to 1.5% of chromium (Cr), 0.01 to 0.8% of molybdenum (Mo), 0.01 to 0.08% of vanadium (V), 50 ppm or less (excluding 0%) of boron (B), and 0.01% to 0.02% of cobalt (Co), further comprising: at least one selected from the group consisting of 0.5% or less (excluding 0%) of nickel (Ni), 0.5% or less (excluding 0%) of copper (Cu), 0.02% or less (excluding 0%) of titanium (Ti), 0.05% or less (excluding 0%) of niobium (Nb), and 2 to 100 ppm of calcium (Ca), and comprising: the remainder of iron (Fe) and other inevitable impurities, wherein the Cr, Mo, and V satisfy Relational Expression 1, and a microstructure thereof includes 90 area % or more of martensite, Relational Expression 1: $Cr \times Mo \times V \geq 0.005$ (where the contents of Cr, Mo, and V are in wt %), wherein the microstructure is observed at ½t location of the wear-resistant steel using an optical microscope and an electron scanning microscope, and wherein the martensite has an average packet size of 30 μm or less, and wherein the martensite packet refers to lath and block martensite groups having the same crystal orientation, and wherein the average packet size of martensite is observed at ½t location of the wear-resistant steel using an optical microscope and an electron scanning microscope, and wherein kernal average misorientation (KAM) of martensite is 0.45 to 0.8, and wherein the kernel average misorientation (KAM) of martensite is analyzed for an area of 200 μm×200 μm of the wear-resistant steel through EBSD, and wherein hardness of the wear-resistant steel is 460 to 540 HB and impact absorption energy of the wear-resistant steel at temperature of −40° C. or less is 47 J or more (where the HB denotes surface hardness of steel measured by a Brinell hardness tester), and wherein the impact absorption energy value is an average of values obtained by measuring toughness three times at a temperature of −40° C. at a ¼t location of the steel.

2. The wear-resistant steel of claim 1, further comprising, by wt %:

at least one selected from the group consisting of 0.05% or less (excluding 0%) of arsenic (As), 0.05% or less (excluding 0%) of tin (Sn), and 0.05% or less (excluding 0%) of tungsten (W).

3. The wear-resistant steel of claim 1, further comprising, by area %:

10% or less of at least one of retained austenite or bainite, wherein the retained austenite or bainite is observed at ½t location of the wear-resistant steel using an optical microscope and an electron scanning microscope.

4. The wear-resistant steel of claim 1, wherein hardness (HB) and impact absorption energy (J) satisfy Relational Expression 2, Relational Expression 2: $HB \times J \geq 25000$ (where HB denotes surface hardness of steel measured by a Brinell hardness tester and J denotes an impact absorption energy value at a temperature of −40° C.), wherein the impact absorption energy value is an average of values obtained by measuring toughness three times at a temperature of −40° C. at a ¼t location of the wear-resistant steel.

* * * * *